US006233806B1

(12) United States Patent
Anderson et al.

(10) Patent No.: US 6,233,806 B1
(45) Date of Patent: May 22, 2001

(54) METHOD OF REMOVING AND CHANGING BRAKE SHOES

(75) Inventors: Norman G. Anderson, Janesville, WI (US); Anthony R. Hiatt, Demotte, IN (US); Rami V. Nassar, Gurnee, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/235,996

(22) Filed: Jan. 22, 1999

(51) Int. Cl.[7] ..... B23P 19/04; B23P 23/00; B23P 6/00

(52) U.S. Cl. ..... 29/402.03; 29/426.1; 29/426.5; 105/167

(58) Field of Search ..... 29/402.03, 402.04, 29/402.08, 426.1, 426.5, 803, 233, 267; 105/167, 168

(56) References Cited

U.S. PATENT DOCUMENTS

| | | | |
|---|---|---|---|
| 4,274,339 | 6/1981 | Cope | 105/168 |
| 4,357,999 | 11/1982 | Cope | 188/52 |
| 4,458,604 | 7/1984 | Cope | 105/168 |
| 5,224,428 | 7/1993 | Wronkiewicz | 105/167 |
| 5,461,987 | 10/1995 | Nassar | 105/167 |

OTHER PUBLICATIONS

American Steel Foundries (Amsted Industries Incorporated) "Brake Shoe Removal for Trucks Fitted With AR–1 Steering Arms".

*Primary Examiner*—S. Thomas Hughes
*Assistant Examiner*—Jermie E. Cozart
(74) *Attorney, Agent, or Firm*—Edward J. Brosius; Stephen J. Manich

(57) ABSTRACT

A steering arm assembly for use with railway car trucks having pivotal frames and brake systems is disclosed. The steering arm assembly has two U-shaped sub-assemblies. Each sub-assembly has two side arms connected by a center arm. The side arms each have vertical open paths between top and bottom holes in their surfaces and open side paths through side access holes in their sidewalls. The open side paths intersect the vertical open paths. The vertical open paths are positioned to be aligned over the brake system brake shoe keys and the side access holes are positioned to be aligned with the side windows in the side frame. When it is desired to remove or replace a brake shoe, the brake shoe key may be moved upwardly through the vertical open path. This movement may be facilitated through use of a tool inserted through the side access hole and open side path in the side arm. A method of changing brake shoe keys and the combination of such a steering arm assembly in a railway car truck is also disclosed.

3 Claims, 6 Drawing Sheets

METHOD OF REMOVING AND CHANGING BRAKE SHOES

FIELD OF THE INVENTION

The present invention relates to an improved system for changing brake shoes in railway cars where structural members interfere with access to the brake shoe keys. More particularly, the present invention relates to railway car trucks and steering arms that are used in conjunction with brake shoes mounted to brake beams through brake shoe keys. The invention also relates to a method of removing brake shoe keys in such railway cars.

BACKGROUND OF THE INVENTION

The usual freight railway car has a car body supported on at least one, and usually two, wheeled trucks that are confined to roll on rails. Typically, such wheeled trucks have brake shoes mounted near to each wheel. The brake shoes are mounted to brake beams by brake shoe keys. The brake shoe keys extend through brackets on the brake shoes and brake beams. As the brake shoes become worn, it is necessary to replace the worn parts, requiring that the brake shoes be removed from the brake beams by removing the brake keys.

Many railway cars are also equipped with steering arms. Steering arms are used to control trucks, especially against hunting or lateral movement during travel around curves. When a railway car truck is equipped with steering arms, removal of a brake shoe generally requires that the steering arms have aligned openings in their top and bottom surfaces through which the brake key may be pushed or pulled. When such brake shoes and steering arms are used with railway cars having a sill that overlies the side frames of the truck, such as in autorack and well cars, removal of the brake shoe keys becomes more difficult for the worker. In such situations, there is little room for the worker to work the key out from its location: there may be little space below for hammering or pounding the key up from below; and the hole or opening in the top of the steering arm is located inboard of the side sill, requiring the worker to reach over the top of the side frame, between the sill and the side frame to pull the brake shoe key out through the steering arm openings. Thus, the worker may have to work without a visual reference when finally removing the brake shoe key. Similarly, when attempting to install a new brake shoe key, the worker may not be able to conveniently see the brake shoe key as it is being installed.

SUMMARY OF THE INVENTION

The present invention is directed toward providing an easier and more efficient method of removing brake shoe keys so that brake shoes may be replaced as desired when they become worn. The present invention achieves this improved method by providing a steering arm or other structural member that makes the brake shoe keys more readily accessible from the outboard side of the railway car truck, giving the worker a greater area in which to work to remove the keys and facilitating the brake shoe key removal and replacement procedures.

DETAILED DESCRIPTION OF THE ILLUSTRATED EMBODIMENT

Figure 1:
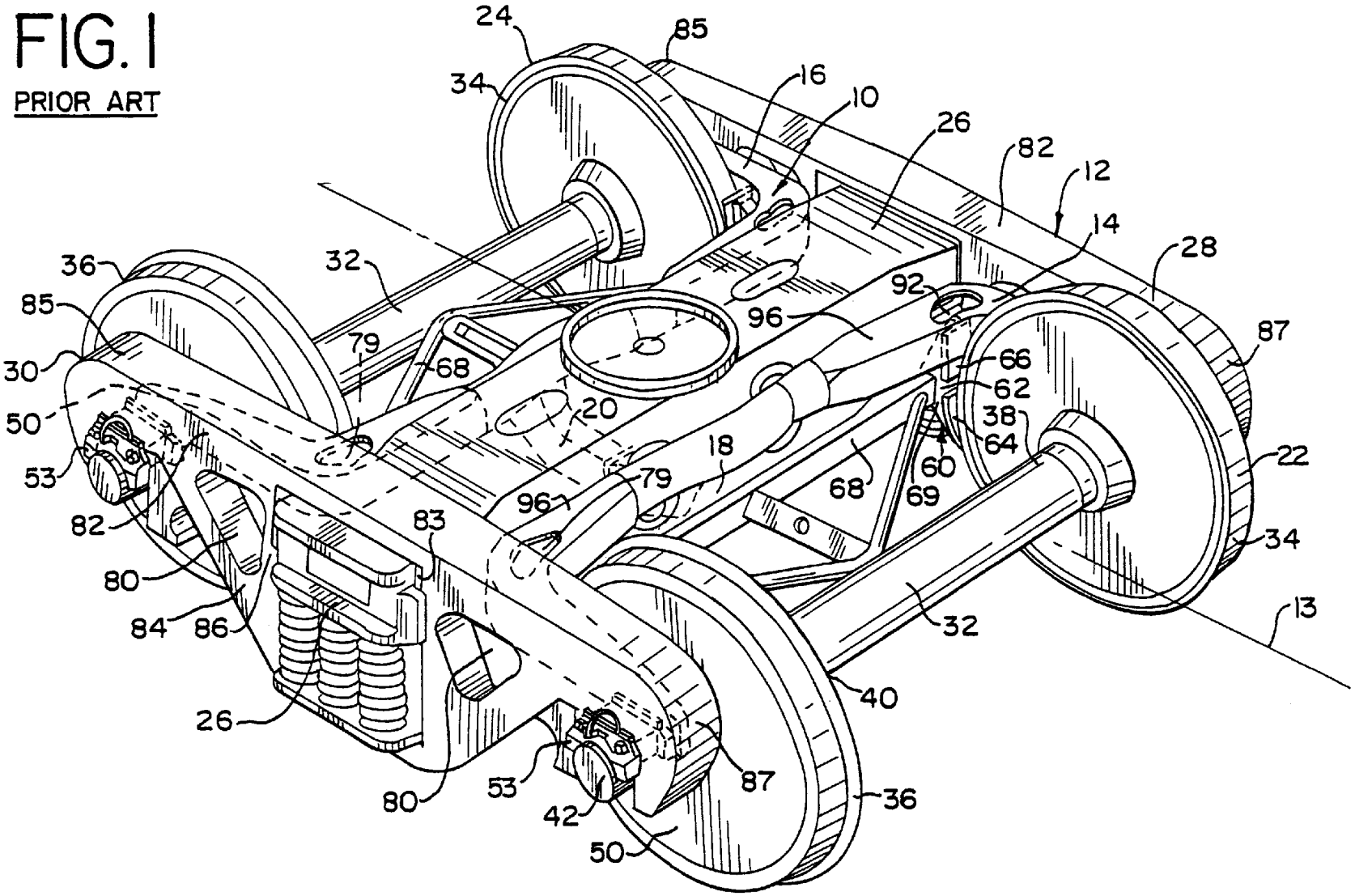
FIG. 1 PRIOR ART
FIG. 1 is a perspective view of a prior art railway car truck with a steering arm assembly and brake assembly.

In FIG. 1, a prior art steering arm assembly 10 is shown on a typical railway car truck 12. The prior art steering arm assembly 10 comprises front and rear steering arm sub-assemblies 14, 16 centrally coupled by necks 18, 20.

Figure 2:
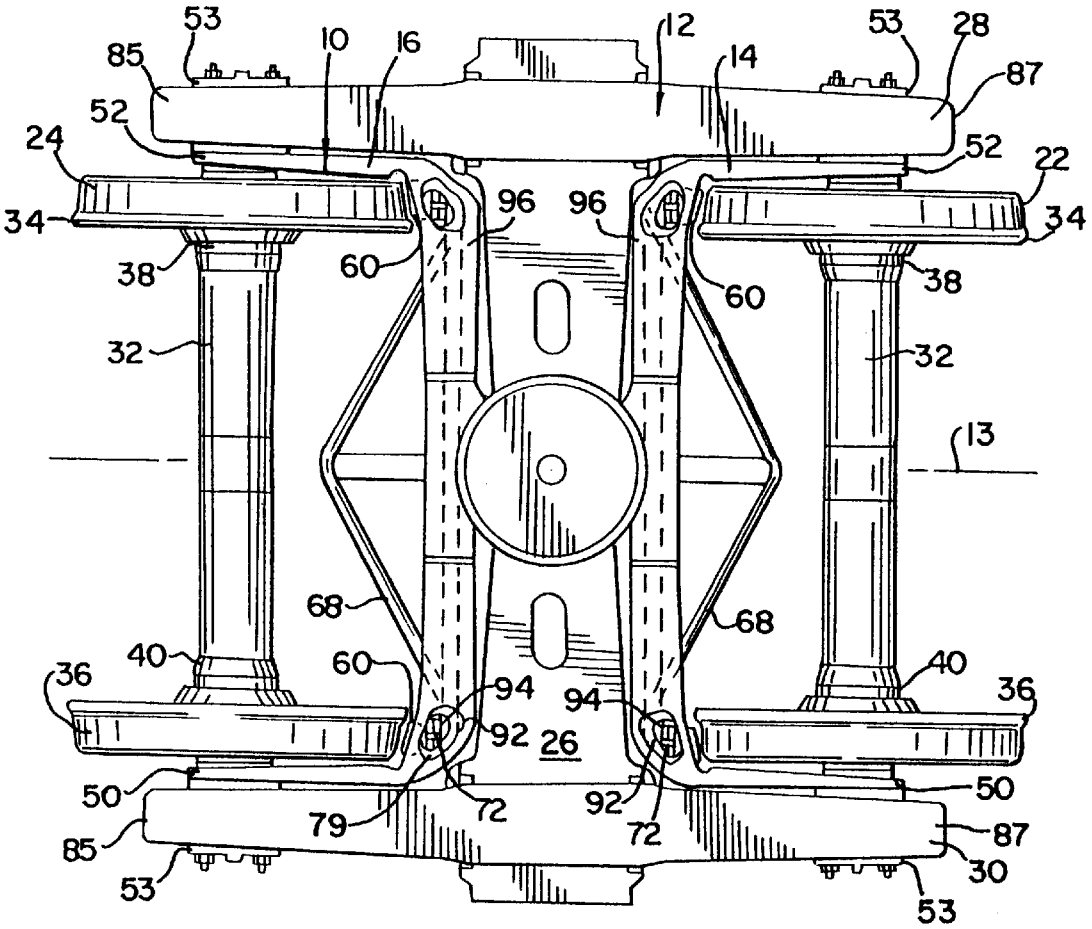
FIG. 2 PRIOR ART
FIG. 2 is a plan view of the railway car truck of FIG. 1.

The prior art railway car truck 12 has a longitudinal axis 13, first and second wheelsets 22, 24, respectively, and a bolster 26. The wheelsets 22, 24 and bolster 26 are transversely coupled to the side frames 28, 30 at the side frames' mid-regions. Each wheelset 22 includes an axle 32 with wheels 34, 36 spaced apart at opposed axle ends 38, 40. End caps and bearing assemblies 42 at the ends of each axle provide for smooth rotation of the wheelsets. As shown in FIG. 2, the truck 12 has a pair of side frames 28, 30 mounted on the axles 32 and supporting the truck bolster 26. The side frames 28, 30 are outboard of the steering arm sub-assemblies 14, 16.

Each prior art steering arm sub-assembly 14, 16 is a generally U-shaped structure of cast metal, usually cast steel. Each sub-assembly 14, 16 has a pair of free ends 50, 52 mounted on an axle 32 just inboard of the side frames 28, 30 and outboard of the wheels 34, 36. At each free end 50, 52, a coupler device 53 is provided for mounting and securing the sub-assembly 14, 16 to an axle 32 and side frame 28, 30.

Figure 3:
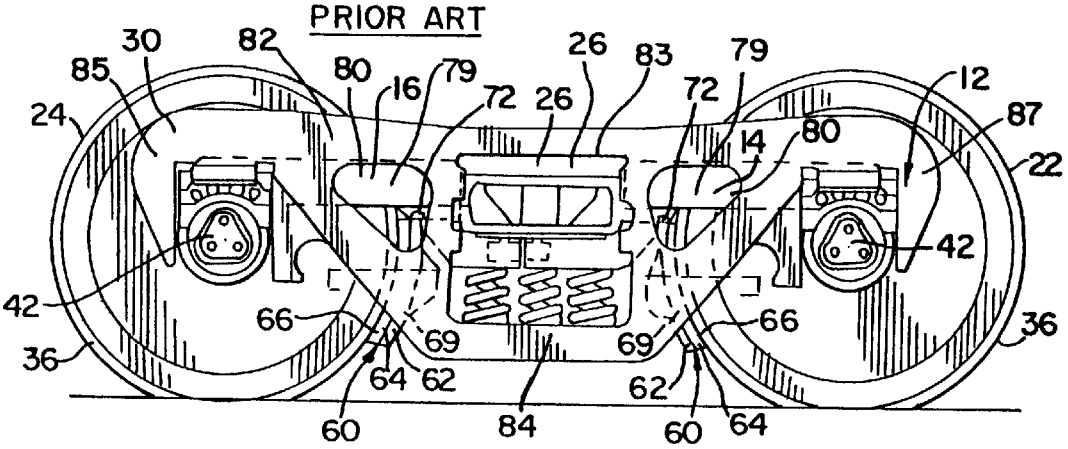
FIG. 3 PRIOR ART
FIG. 3 is a side elevation of the railway car truck of FIG. 1.

As shown in FIGS. 1–9, such prior art trucks generally have brake shoes 60 that operate by acting against the wheels 22 of the trucks 12 to slow or stop the railway car. Such brake shoes 60 generally comprise, as shown in FIGS. 1 and 3, a metal backing plate 62 to which is secured a core element 64 with a contact surface 66. The contact surface 66 is typically made of a high-friction material and is operable to contact the wheel tread at the contact surface; the high-friction material at the contact surface grips the wheel tread with minimal force applied, slowing the railway car. There are generally four brake shoes for each wheel truck, so that there is one brake shoe for each wheel on the truck.

The prior art brake shoes 60 are mounted at the ends of a brake beam or other brake shoe support structure 68. The brake beams 68 are generally perpendicular to the longitudinal axis 13 of the railway car truck 12. The brake beams 68 can be moved between different positions: the brake beams can be moved to where the contact surface 66 is held away from the wheel tread and can be moved to a braking position where the contact surface is pushed against the wheel tread. The brake beams 68 are moved by brake levers (not shown), which in turn may be moved by brake cylinders (not shown). The brake shoes 60 are mounted on brake beam heads 69 at the ends of the brake beams 68. The brake beam heads 69 at the ends of the brake beams 68 are just inboard of the side frames, between the wheels and the bolster.

As the brake shoes are used, the contact surfaces 66 tend to become worn so that the core elements 64 need replacement. Accordingly, the brake shoes 60 are removably attached to the brake beam heads 69 so that the brake shoes can be removed from the remaining structure and replaced with a new brake shoe or one that has been refitted with a new core element or contact surface. The connection of the brake shoes 60 to the brake beam heads 69 is generally through brake shoe keys 72 that fit in brackets on the metal backing plates 62 of each brake shoe and mating brackets on the brake beam heads 69. Generally, the brake shoe keys are slipped into place from above the brake shoe for an interference, spring action, or keyed fit between the brackets on the brake shoe metal backing plate and another receptacle on the brake beam head. The brake shoe key is pushed down until a tab 76 on the upper end of the brake shoe key reaches the brake shoes. The tab 76 is a short segment of the brake shoe key that extends out at and angle from the remaining long segment 78 of the key 72 that is received in the bracket of the metal backing plate.

To remove or insert a brake shoe key 72, the key must be moved through an area or zone above the brake shoe. This area or zone is about the length of the brake shoe key. This area or zone is referred to as the key removal zone 79 throughout the specification and claims.

Figure 4:
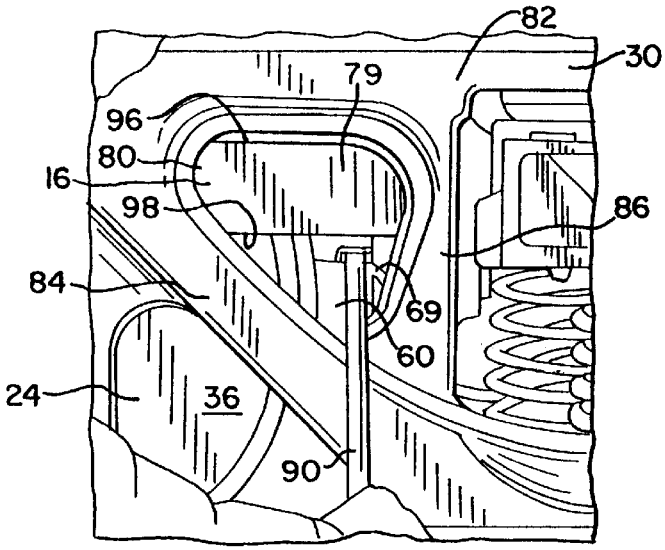
FIG. 4 is an enlarged side elevation view of a portion of the prior art side frame of FIG. 1, showing a first step in the prior art method of removing a brake key from a brake shoe, wherein the brake key is being pried up for removal.
Figure 5:
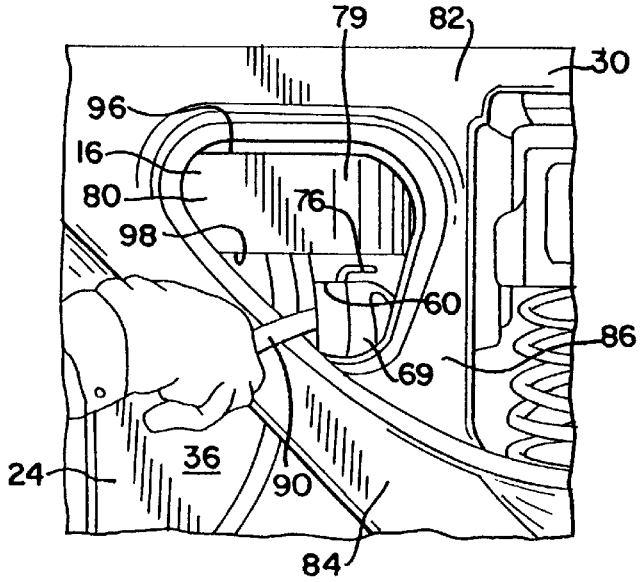
FIG. 5 is an enlarged side elevation view of a portion of the prior art side frame of FIG. 1, showing a second step in the prior art method of removing a brake key from a brake shoe, wherein the brake shoe is being pushed back from the wheel to align the brake key with the holes in the steering arm.
Figure 6:
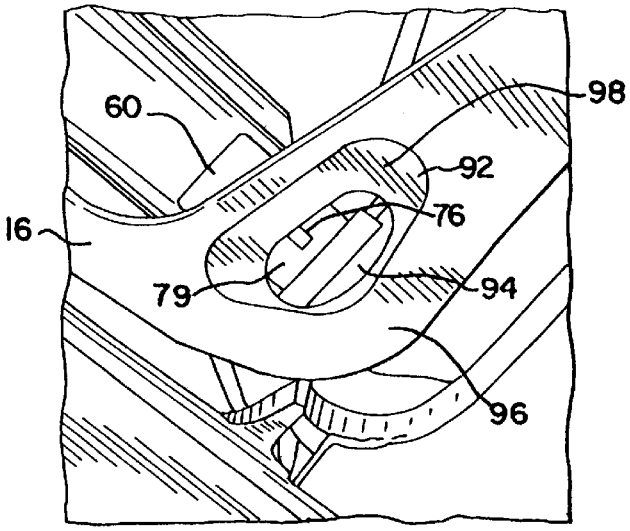
FIG. 6 is an enlarged plan view of a portion of the prior art side frame of FIG. 1, showing the brake key aligned with holes in the steering arm.

The prior art steps for removing a brake shoe key are shown in FIGS. 4–9. As there shown, access to the brake shoe key 72 is generally through the side window 80 of the side frame 28. As illustrated, each side frame 28 has a pair of side windows 80, one between the mid-region 83 and the front end 85 and one between the mid-region 83 and the back end 87. To remove the brake shoe key 72, the worker, designated 88 in the accompanying figures, inserts a prying tool 90 through the side frame window 80 and under the tab 76 of the brake shoe key 72, pries the tab upward, as shown in FIG. 4. The worker 88 may need to pry the brake shoe 60 away from the wheel, as shown in FIG. 5, to align the brake shoe key 72 with the overlying vertically-aligned holes 92, 94 in the steering arm sub-assembly 16. To fully remove the brake shoe key 72, the brake shoe key must be pushed or pulled upward through vertically-aligned holes 92, 94 in the top and bottom walls 96, 98 of the steering arm sub-assembly 16. The vertically-aligned holes 92, 94 are in the key removal zone 79. However, because of the presence of the steering arm sub-assembly 16, a portion of the window 80 is partially blocked, and the worker can only pry upward a small part of the distance required to fully remove the brake shoe key 72 from the brake shoe backing plate 62. Thus, the steering arm assembly 10 limits access for manipulation of the brake shoe key 72 in the key removal zone 79.

Figure 7:
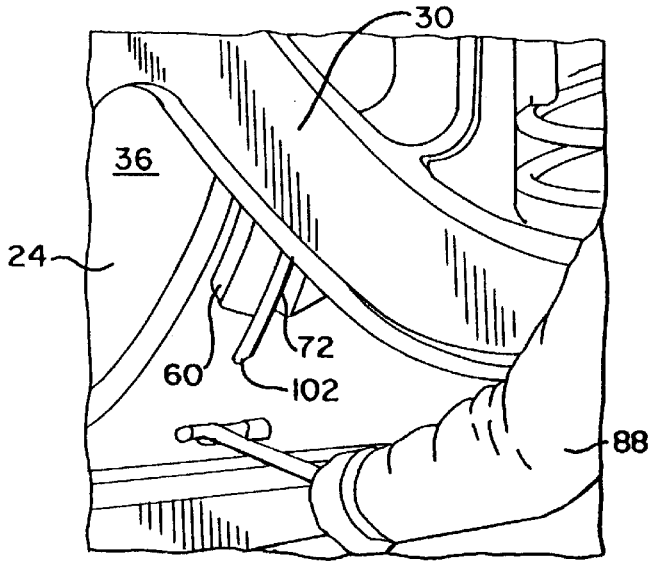
FIG. 7 is an enlarged side elevation view of the prior art side frame of FIG. 1, showing another step in the prior art method of removing a brake key from a brake shoe, wherein the lower end of the brake key is being tapped up for removal.
Figure 8:
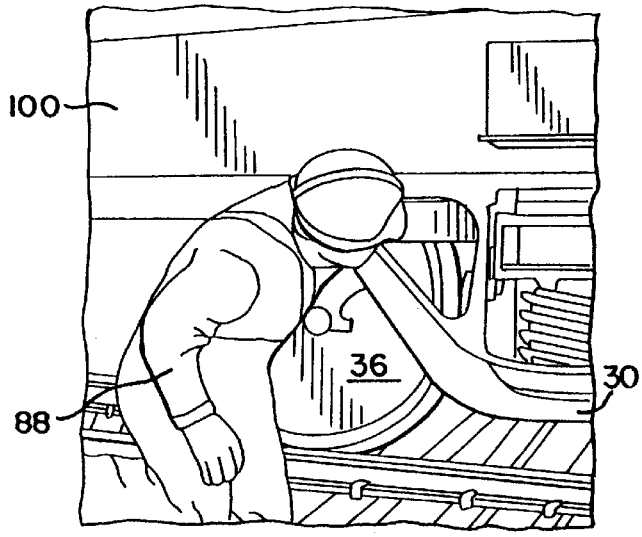
FIG. 8 is an enlarged side elevation view, showing a portion of the prior art railway car truck of FIG. 1 mounted under a rail car, and showing another step in the prior art method of removing a brake key from a brake shoe, wherein a worker is reaching over the side frame and under the car side sill to reach the brake key.
Figure 9:
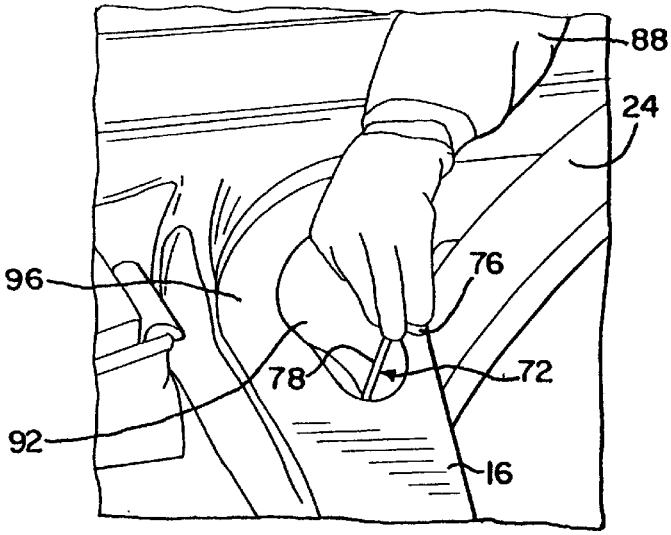
FIG. 9 is an enlarged top plan view of the prior art side frame of FIG. 1, showing another step in the prior art method of removing a brake key from a brake shoe, wherein the worker is pulling upward on the brake shoe key to remove it.

This limited available prying distance in the prior art may present problems when the wheel trucks 12 are used with railway cars such as autorack and well cars where the railcar side sills 100 overhang the truck side frames 28, 30 as shown in FIG. 8. To remove the brake shoe key 72 in such railway cars, the worker may tap upwardly on the bottom end 102 of the brake shoe key 72 as shown in FIG. 7 to push the key to the point where the top tab 76 has passed entirely through the vertical passage through the holes 92, 94 in the steering arm; but there is limited room available for the worker to swing the hammer upward, and the upward movement may be inefficient. And then the worker 88 must reach around under the side sill 100 and over the side frame 28, as shown in FIGS. 8 and 9, to manually pull up on the brake shoe key tab 76 to finally remove the key 72 from the brake shoe. But the workers may have difficulty seeing what they are doing, requiring them to rely upon feel, again making the removal operation less efficient than desirable. To reinsert the key when replacing the brake shoe, the workers must reverse the process to guide the key into the brake shoe bracket with less than optimal visibility and accessibility.

The present invention provides for improved visibility, a more accessible work space and more efficient removal and replacement of the brake shoe keys. In particular, the present invention provides for improved access for manipulation of the brake shoe key in the key removal zone 79 when a steering arm assembly, or any other structural member, is limiting or interfering with such access. The present invention may be used with prior art brake shoes, brake shoe keys, brake beams, brake beam heads, side frames, wheelsets and bolsters, such as those illustrated in FIGS. 1–9.

Figure 10:
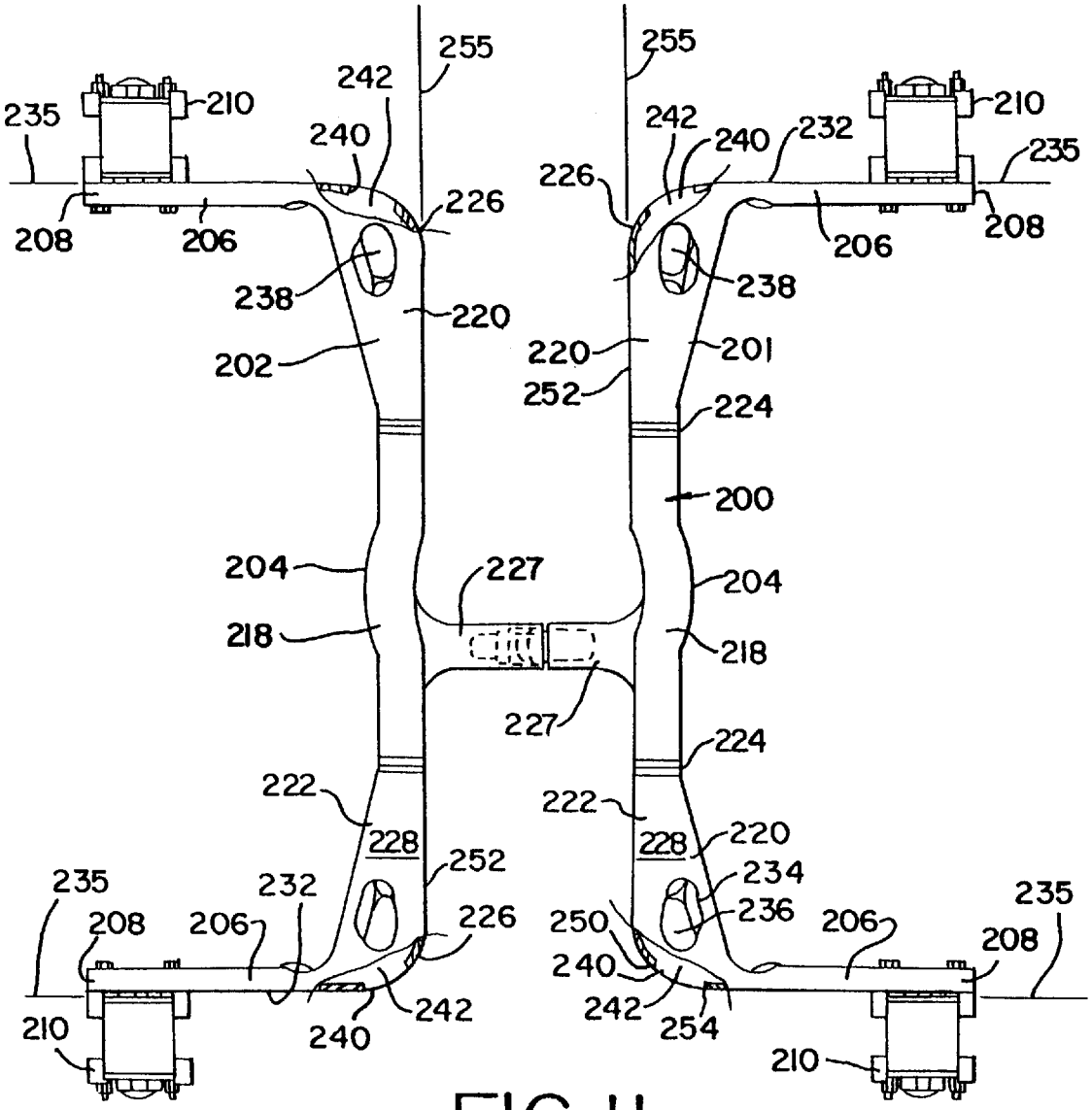
FIG. 10 is a top plan view of the steering arm assembly of the present invention, with parts shown in cross-section.
Figure 11:
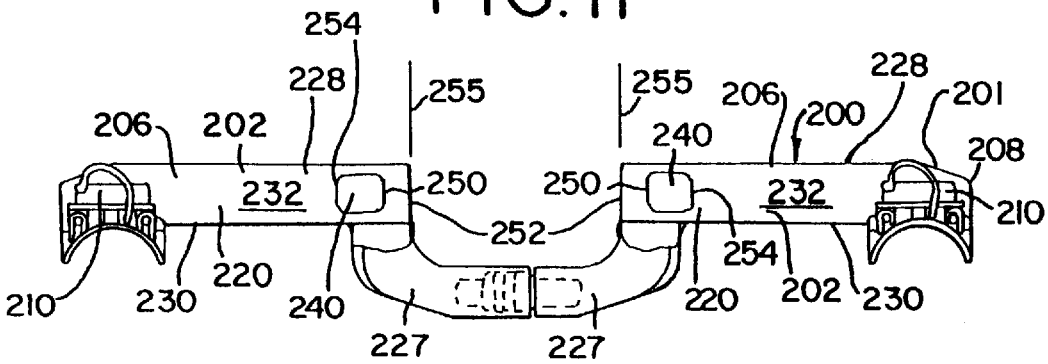
FIG. 11 is a side elevation view of the steering assembly of FIG. 10.
Figure 12:
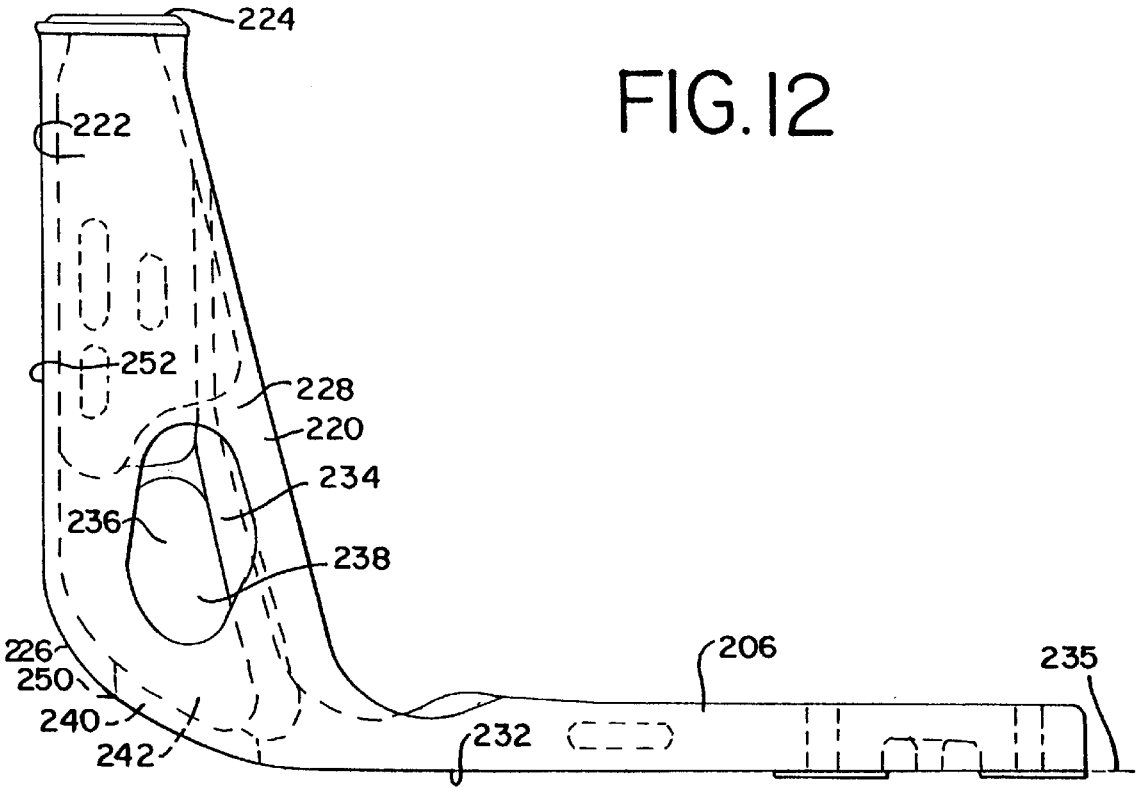
FIG. 12 is an enlarged top plan view of one steering arm sub-assembly.
Figure 14:
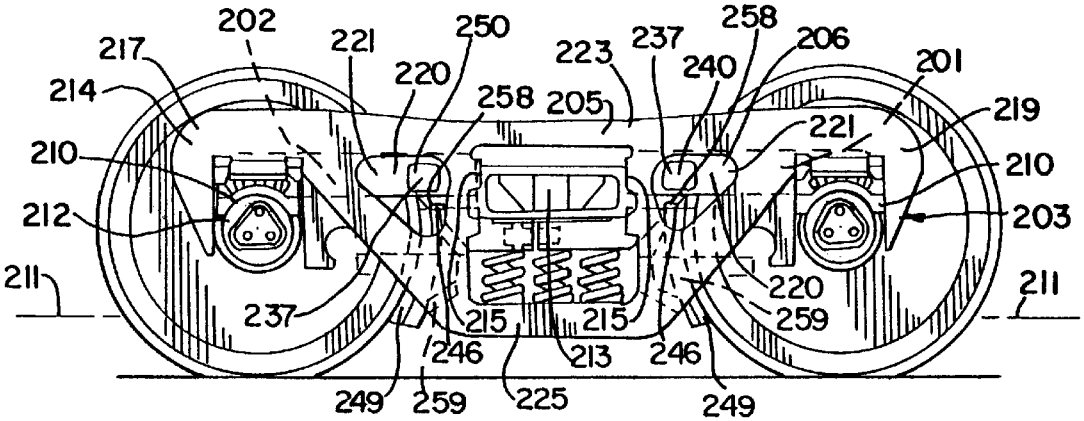
FIG. 14 is an enlarged side elevation view of a portion of the steering assembly of the present invention mounted on a railway car truck.

As shown in FIGS. 10–11, a steering arm assembly 200 in accordance with the present invention may include two generally U-shaped sub-assemblies 201, 202. When mounted on a railway wheel truck 203, as shown in FIG. 14, each sub-assembly 201, 202 extends between the side frames 214, along the truck bolster 205, and along the side frames to the wheel sets as in the prior art. The sub-assemblies have free ends 208 that may be connected to coupler devices 210 for mounting and securing each sub-assembly 201, 202 to an axle 212 and side frame 214 of a railway wheel truck 203 as shown in FIG. 14, as in the prior art. As in the prior art, each side frame 214 has a longitudinal axis 211, a mid-region 213 bounded by columns 215, front and back ends 217, 219 and side windows 221 between the ends 217, 219 and mid-region 213. Compression and tension members 223, 225 may lie above and below the side windows 221.

In the illustrated embodiment, each sub-assembly 201, 202 has a cross beam or center arm 218 connecting two mirror-image side arms 220. Each illustrated side arm 220 includes the longitudinal portion 206 and a transverse portion 222. The transverse portion 222 of each side arm is co-linear or co-axial with the center arm 218. Each transverse portion 222 of each side arm 220 has an end 224 that is connected or joined to an end of the center arm 218. Each of the illustrated center arms 218 has a neck 227 that connects the two sub-assemblies 201, 202 together into the steering arm assembly 200. The two necks 227 may extend through the bolster 205 when mounted on the railway wheel truck 203.

When the sub-assemblies 201, 202 are mounted on a railway car truck, each longitudinal portion 206 extends along the inboard side of one of the side frames. The transverse portion 222 of each side arm extends along one side of the bolster.

In each of the illustrated side arms 220, the transverse portion 222 and longitudinal portion 206 intersect, and are generally perpendicular to each other. The transverse and longitudinal portions 222, 206 are integral and meet or are connected at a junction or bend 226. Each junction 226 is generally aligned to be visible through one side frame window 221.

Although the illustrated embodiment shows a three-piece sub-assembly, it should be understood that each sub-assembly could be made of fewer or more pieces. The invention is not limited to the particular type of steering arm assembly illustrated.

Each illustrated side arm 220 has parallel top and bottom surfaces 228, 230 connected by a connecting surface or side wall 232. The sidewall 232 is integral with the top and bottom surfaces 228, 230 and is generally perpendicular to them. When mounted on a railway wheel truck 203, the connecting surface or side wall 232 is vertical; the part of the side wall on the longitudinal portion 206 faces outwardly toward the adjacent side frame 214, as shown in FIG. 14, and as in the prior art, and the part of the side wall on the transverse portion 222 faces the bolster.

Each side arm 220 includes top and bottom holes 234, 236 in the top and bottom surfaces 228, 230 respectively, at or near the junction or bend 226 in the side arm. The top and bottom holes 234, 236 are vertically aligned. Between the holes 234, 236, the side arm is hollow to define a vertical open space or vertical open path 238 between the top and bottom holes 234, 236. When mounted on a railway truck, the sidewall 232 of the longitudinal portion 206 lies in a vertical plane 235 nearest the adjacent side frame. The top and bottom holes are spaced from this plane 235.

When mounted on a railway car truck, the top and bottom holes 234, 236 and vertical open space or path 238 are in the key removal zone 237. The presence of the steering arm assembly 200 in the key removal zone 237 could limit access for manipulation of the brake shoe key in that zone.

To improve access for manipulation of the brake shoe key, the present invention provides a side access hole 240 at or near each junction or bend 226 of each side arm 220. Each side access hole 240 communicates with the vertical open space or path 238, and provides an open side path or space 242. The open side path or space 242 intersects the vertical open path or space 238. The open side path or space 242 is spaced from both ends 208, 224 of the side arm. The improved access provided by these side access holes 240 allows for tools to be physically inserted into each sub-assembly to facilitate movement of the brake shoe key through the sub-assembly. The side access holes 240 also provide improved visibility of the brake shoe key 246 as it is moved through the steering arm sub-assembly. Accordingly, the side access holes 240 are sized, shaped and positioned to allow a tool to be inserted through the side windows 221 of the side frame 214 and through the side access holes 240 and into the vertical open space 238. Thus, the present invention allows for tools to be inserted into parts of the key removal zone 237 previously blocked by the steering arm assembly.

Each side access hole 240 is positioned at or near each side arm junction or bend 226. in the part of the outer side wall or connecting surface 232 of the side arm 220, facing the side frame. As shown in FIG. 14, each side access hole 240 is positioned so that when the steering arm assembly 200 is mounted on a side frame 214, the side access hole 240 is aligned with one of the side windows 221 of the adjacent side frame. The top and bottom holes 234, 236 generally overlie one of the brake shoe keys 246, and the brake shoe key 246 may be removed by moving it upwardly through the bottom hole 236, through the vertical open space or path 238 and through the top hole 234 in the adjacent steering arm sub-assembly 201, 202.

The side access holes 240 are sized, shaped and positioned to allow a tool to be inserted through the side frame side window 221 and through the side access hole 240 and open side path 242 to contact the brake shoe key in the vertical open space 238. The side access hole 240 may also be large enough to allow a visual reference for movement of the brake shoe key while not detracting substantially from the strength of the steering arm assembly.

One side access hole is provided at or near each of the four junctions 226 in the steering arm assembly 200. Each side access hole 240 is associated with one of the four brake shoes 249 on the railway wheel truck 203.

Figure 13:
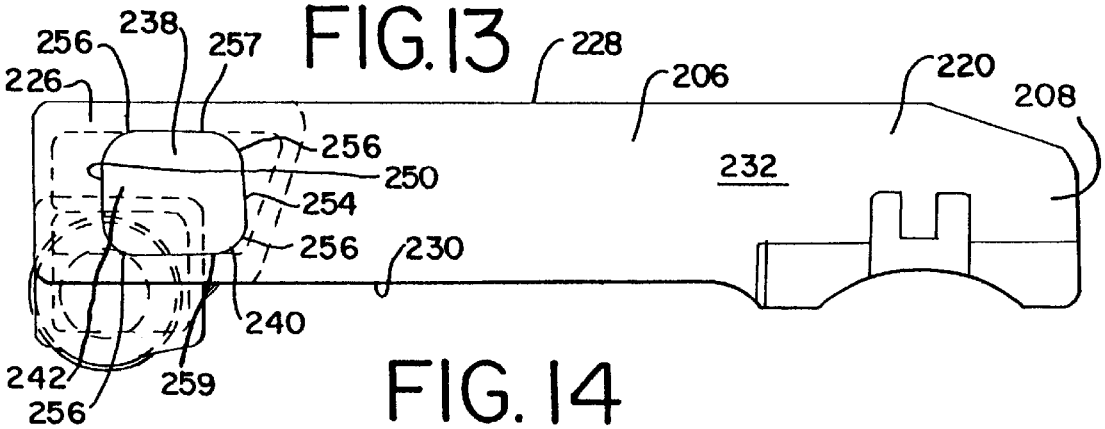
FIG. 13 is an enlarged side elevation view of one steering arm sub-assembly.

In the illustrated embodiment, each side access hole 240 is generally rectangular in shape, about four inches wide by about three inches (3.38 inches) high. Each side access hole is centered between the top and bottom surfaces 228, 230 of the steering arm, being spaced about 0.81 inches from each surface 228, 230. The rear vertical edge 250 of each side access hole 240, that is, the edge nearest the necks 227 connecting the two sub-assemblies 202 and farthest from the free ends 208 of the longitudinal portions 206, is spaced about two inches from the plane of the rear edge 252 of the associated transverse portion of the side arm 222. The front vertical edge 254 of each of the illustrated side access holes 240 is positioned 23.38 inches from the free end 208 of the associated longitudinal portion 206 of the side arm 222. In the illustrated embodiment, the front and rear vertical edges 252, 254 are parallel to each other and spaced from the vertical plane 255 through the portion of the steering arm assembly that is nearest the truck bolster 205 when the assembly is mounted on a wheel truck 203; the plane 255 extends along the edge of the center arm 214. The four corners 256 of each illustrated side access hole 240 are rounded, with radii of curvature of about three-quarters of an inch or one inch, for example. Smaller radii of curvature may be employed, but radii of about one inch may be preferred for lower stresses on the structure. As shown in FIG. 13, the top and bottom edges 257, 259 are parallel to each other and perpendicular to the front and rear edges 252, 254.

It should be understood that the dimensions for the side access holes 240 described are provided for purposes of illustration only. Generally, the size and shape of the side access holes may be adjusted as desired, although it is preferred that the holes be sized, shaped and positioned to align with the side frame side windows and be large enough to allow a tool to be fit within the hole. The size, shape and position of the side access hole should not be such as to create undue stress in the structure. Sizes, shapes and positions may vary with the size or rating of the car truck; the example given is for a 70 ton truck, and some variation may be expected for 100 and 125 ton trucks. As will be understood by those of skill in the art, it may be desirable to test other sizes, shapes and positions of side access holes with stress gauges placed at appropriate locations on the steering arm.

The steering arm assembly 200 of the present invention may be cast of steel such as Grade B steel as is common in the art. Cores may be provided, or print supports may be provided on existing cores to define the side access holes 240. As stresses in the bottoms of the side access holes may be as high as those in the wheel clearance and center appendage radius locations, it may be desirable to mechanically finish the cast steering arm, such as by weld repair or by grinding out defects that could start a crack. The inclusion of the side access holes described above should not adversely affect the strength of the steering arms. The steering arm assemblies with side access holes may be installed and used as known in the art.

The present invention also provides a method of changing brake shoes 249 in such railway wheel trucks. A prying tool such as a crowbar or other lever may be inserted through the side frame window 221 and an end placed beneath the tab 258 of the brake shoe key 246. The brake shoe key may then be raised toward the steering arm assembly until the tab 258 is visible through or just beneath the side access hole 240. The prying tool may be pulled out and it or some other tool may be inserted through the window 221 and side access hole 240 to apply against the brake shoe key tab 258 to continue raising the brake shoe key. The brake shoe key may be moved upward through the vertical open path 238 until the brake shoe is free from the head 259 of the brake beam or other support structure. A new brake shoe, or one with a new core element or bearing pad, may then be attached to the brake beam head 259 by inserting a brake shoe key into the mating brackets to mount the brake shoe 249 to the brake beam head 259. The present invention facilitates this insertion by providing a visual reference through the side access hole 240 for guiding the brake shoe key 246 into position.

It should be understood that the apparatus and method of the present invention might be used in other environments. For example, in any environment where a structural member occupies the key removal region above the brake shoe, use of the side access hole of the present invention may be helpful. Any element that interferes with access to grabbing the brake shoe key by hand, or that limits visual or physical access to the brake shoe key could use the side access hole of the present invention. Such elements could, for example, comprise part of the car design, the brake system, or test equipment, regardless of whether the element was mounted as part of or on the truck.

While only a specific embodiment of the invention has been described and shown, it is apparent that various alternatives and modifications can be made thereto. For example, although particular dimensions, positions and materials have been identified for the illustrated embodiment, the invention is not limited to those dimensions, positions or materials and modifications may be made without departing from the invention. In addition, although the invention has been described with respect to a particular steering arm assembly structure, the principles of the invention may be applied to other steering arm assembly structures. Those skilled in the art will recognize that certain modifications can be made in this illustrative embodiment, and that the principles can be applied to other structures to produce alternative designs. It is, therefore, the intention in the appended claims to cover all such modifications and alternatives as may fall within the true scope of the invention.

We claim:

1. In a railway car of the type with a railway car truck having a longitudinal axis and including:

a pair of spaced railway car truck side frames, a bolster extending transversely between the pair of side frames and perpendicular to the longitudinal axis of the railway car truck, each of the side frames having a mid-region, front and back ends, a side window between the front end and the mid-region, and a side window between the back end and the mid-region, a pair of spaced wheelsets, each wheelset having spaced apart wheels, one wheelset being mounted at the front end of the side frames and one wheelset being mounted at the back end of the side frames, a brake system including a brake beam and a brake shoe removably mounted on the brake beam and juxtaposed with one wheel, the brake shoe having a removable brake shoe key for mounting the brake shoe on the brake beam;

a steering arm assembly including a front and a rear sub-assembly, each sub-assembly having top and bottom surfaces with top and bottom holes aligned to define a vertical open path between the top and bottom surfaces, each vertical open path being positioned above each brake shoe key, a method of removing a brake shoe from the brake beam comprising the steps of:

providing a side access hole in each sub-assembly, each side access hole providing an open, side path intersecting each vertical open path, each side access hole being aligned with the adjacent side window of the adjacent side frame;

inserting a tool through one side frame window and through the associated side access hole and applying the tool to the brake shoe key to move the brake shoe key upwardly through the vertical open path and through the steering arm assembly;

moving the brake shoe key upwardly through the vertical open path until the brake shoe is free from the brake beam; and separating the brake shoe from the brake beam.

2. The method of claim 1 further comprising the steps of inserting a tool through one of the side windows and applying the tool to the associated brake shoe key to raise the brake shoe key toward the bottom surface of the sub-assembly before the step of inserting a tool through the side window and the associated side access hole.

3. In a railway car of the type with a railway car truck having a longitudinal axis and including:

a pair of spaced railway car truck side frames, a bolster extending transversely between the pair of side frames and perpendicular to the longitudinal axis of the railway car truck, each of the side frames having a mid-region, front and back ends, a side window between the front end and the mid-region, and a side window between the back end and the mid-region, a pair of spaced wheelsets, each wheelset having spaced apart wheels, one wheelset being mounted at the front end of the side frames and one wheelset being mounted at the back end of the side frames, a brake system including a brake beam and a brake shoe removably mounted on the brake beam and juxtaposed with one wheel, the brake shoe having a removable brake shoe key for mounting the brake shoe on the brake beam;

a steering arm assembly including a front and a rear sub-assembly, each sub-assembly having top and bottom surfaces with top and bottom holes aligned to define a vertical open path between the top and bottom surfaces, each vertical open path being positioned above each brake shoe key, a method of changing brake shoes comprising the steps of:

providing a side access hole in each sub-assembly, each side access hole providing an open side path intersecting each vertical open path, each side access hole being aligned with the adjacent side window of the adjacent side frame;

removing the brake shoe from the brake beam by inserting a tool through one side frame window and through the associated side access hole and applying the tool to the brake shoe key to move the brake shoe key upwardly through the vertical open path and through the steering arm assembly, moving the brake shoe key upwardly through the vertical open path until the brake shoe is free from the brake beam, and separating the brake shoe from the brake beam;

providing a replacement brake shoe, the replacement brake shoe and the brake beam having mating members to receive the brake shoe key;

placing the replacement brake shoe near the brake beam;

inserting the brake shoe key into the mating members of the replacement brake shoe key and brake beam to mount the replacement brake shoe to the brake beam.

* * * * *